US005660019A

United States Patent [19]

Roe

[11] Patent Number: 5,660,019

[45] Date of Patent: Aug. 26, 1997

[54] CONCRETE SMOOTHING APPARATUS

[76] Inventor: Cliffton L. Roe, 38020 Hazel, Harrison Township, County of Macomb, Mich. 48045

[21] Appl. No.: 463,915

[22] Filed: Jun. 5, 1995

[51] Int. Cl.[6] ..... E04G 21/46; A46B 7/06

[52] U.S. Cl. ..... 52/741.41; 52/371; 52/749.13; 404/97; 404/118; 15/201; 264/293

[58] Field of Search ..... 52/371, 741.41, 52/749.1, 749.13; 404/96, 97, 118; 15/201, 222, 81, 79.1; 264/31, 293, 333; 425/470, 472, 445

[56] References Cited

U.S. PATENT DOCUMENTS

| | | | |
|---|---|---|---|
| 867,852 | 10/1907 | Switzer et al. . | |
| 883,548 | 3/1908 | Laitner | 15/201 |
| 1,817,687 | 8/1931 | Heltzel . | |
| 2,155,571 | 4/1939 | Tullis | 94/45 |
| 2,571,876 | 10/1951 | Heltzel | 15/80 |
| 2,734,433 | 2/1956 | Brown | 94/45 |
| 3,936,209 | 2/1976 | Krage | 404/118 X |
| 4,702,640 | 10/1987 | Allen | 404/75 |
| 4,722,637 | 2/1988 | Glesmann | 404/118 |
| 4,759,658 | 7/1988 | Manor | 404/93 |
| 4,789,265 | 12/1988 | Wilson et al. | 404/75 |
| 4,917,533 | 4/1990 | Wilson | 404/96 X |

FOREIGN PATENT DOCUMENTS

| | | | |
|---|---|---|---|
| 1210409 | 2/1966 | Germany | 15/201 |

*Primary Examiner*—Wynn E. Wood
*Assistant Examiner*—Timothy B. Kang
*Attorney, Agent, or Firm*—Young & Basile, P.C.

[57] ABSTRACT

An apparatus and methodology for smoothing relatively small pads of freshly laid concrete. The apparatus comprises a pair of broom assemblies joined by a gang bar structure and each pivotally movable on the gang bar structure between first and second angularly displaced positions. A first rope is connected to the apparatus and moves the apparatus across the pad in one direction in response to pulling on the first rope, and a second rope is connected to the apparatus and moves the apparatus across the pad in an opposite direction in response to pulling on the second rope. Utilizing the smoothing apparatus, and with first and second workers positioned on opposite sides of the pad and the broom assemblies in their first angular positions, the apparatus may be moved in one direction across a first section of the pad, with the first worker pulling on the first rope and the second worker commensurately letting out the second rope, whereafter the apparatus may be moved laterally on the pad to overlie a second section of the pad laterally adjacent the first pad section and the apparatus may be moved in the opposite direction across the second section of the pad with the broom assemblies in their second angular positions, the second worker pulling on the second rope, and the first worker commensurately letting out the first rope. This procedure is repeated for successive pad sections with the direction of movement of the apparatus being reversed for each successive section.

12 Claims, 3 Drawing Sheets

FIG - 3
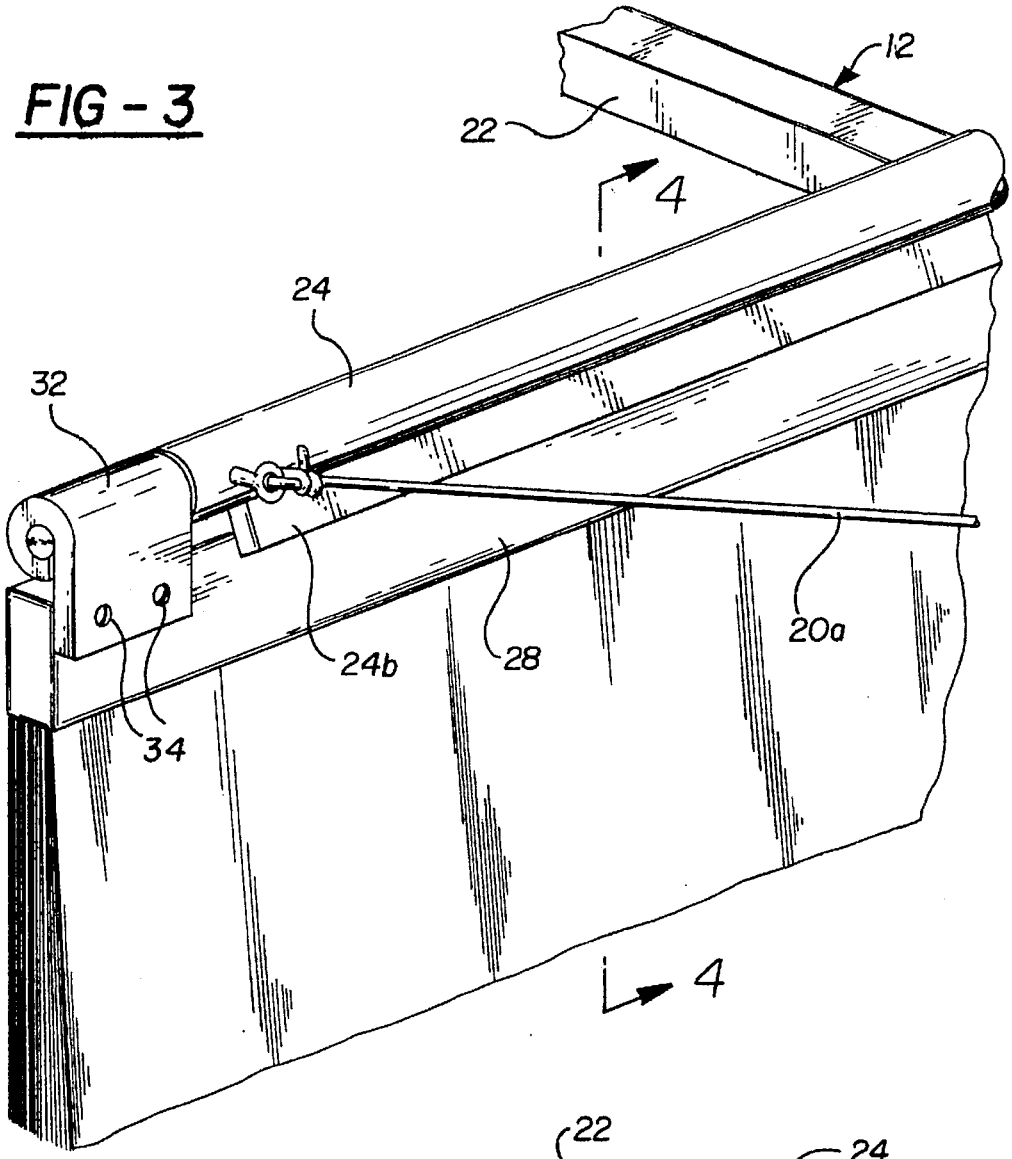
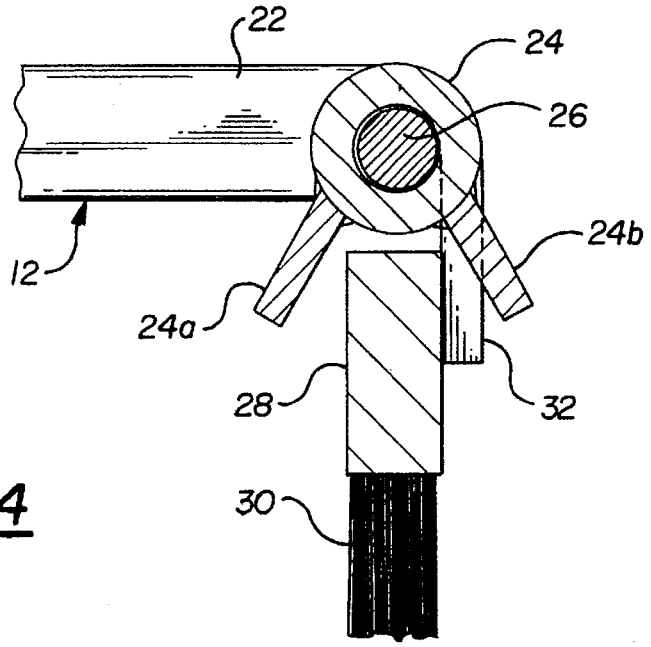
FIG - 4

CONCRETE SMOOTHING APPARATUS

BACKGROUND OF THE INVENTION

This invention relates to concrete smoothing apparatuses and more particularly to a manual concrete smoothing apparatus for use in smoothing relatively small areas of fresh concrete.

Fresh concrete, when laid in large areas, is typically smoothed utilizing power machinery. However, when the area of the freshly laid cement is relatively small, hand smoothing techniques, employing brooms or burlap and the like, are typically utilized to accomplish the smoothing function. This hand smoothing technique is very time consuming and often does not produce a totally satisfactory surface.

SUMMARY OF THE INVENTION

The invention is directed to the provision of an improved smoothing apparatus and methodology for manually smoothing small areas of freshly laid concrete.

The methodology comprises the steps of providing a broom assembly having a bristle structure pivotally movable between first and second angularly displaced positions; providing a first flexible member arranged to pull the broom assembly in one direction; providing a second flexible member arranged to pull the broom assembly in an opposite direction; positioning a first worker at one side of the pad; positioning a second worker at an opposite side of the pad; positioning the broom assembly on a first section of the pad with the bristle structure in the first angular position; moving the broom assembly in the one direction across a first section of the pad with the first worker pulling on the first flexible member and the second worker commensurately letting out the second flexible member, whereby to move the broom assembly across the pad to smooth the first section of the pad; thereafter moving the broom laterally on the pad to a second section of the pad laterally adjacent the first pad section and moving the broom assembly in the opposite direction across the second section of the pad with the bristle structure in the second angular position, the second worker pulling on the second flexible member, and the first worker commensurately letting out the first flexible member, whereby to smooth the second section of the pad; and repeating the procedure for successive pad sections, with the direction of movement of the broom assembly across the pad being reversed for each successive pad section, until the entire pad has been smoothed. This basic methodology shortens the time required to perform the smoothing operation as well as improving the quality of the smoothing operation.

According to further feature of the invention methodology, the broom assembly comprises a first broom assembly and forms a part of a smoothing apparatus; the smoothing apparatus further includes a second broom assembly including a bristle structure, pivotally movable between first and second angularly spaced positions, and a gang bar joining the first and second broom assemblies; and the first and second flexible members are connected to opposite ends of the smoothing apparatus and are operative to move the smoothing apparatus in opposite directions across the pad. This specific methodology, employing this specific smoothing apparatus structure, allows the smoothing operation to be performed quickly and effectively with a minimum of expense and utilizing relatively unskilled labor.

The invention also provides a unique smoothing apparatus especially suited for carrying out the invention methodology.

BRIEF DESCRIPTION OF THE DRAWINGS

FIG. 3 is a fragmentary view showing details of a portion of the invention smoothing apparatus; and FIG. 4 is a cross-sectional view taken on line 4—4 of FIG. 3.

DETAILED DESCRIPTION OF THE PREFERRED EMBODIMENT

Figure 1:
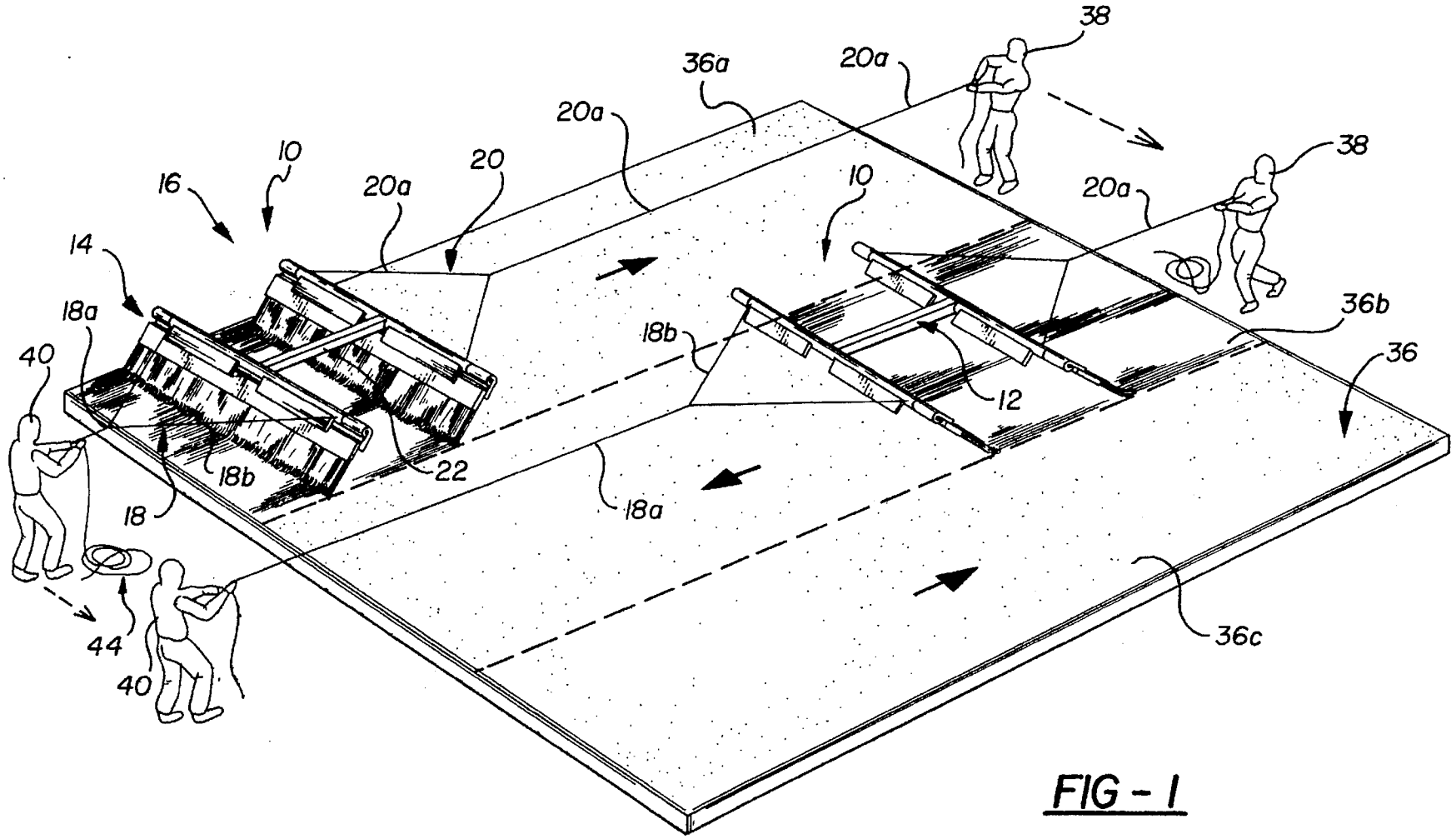
FIG. 1 is a perspective somewhat schematic view illustrating the invention smoothing apparatus and the invention methodology.

The invention smoothing apparatus, broadly considered, includes a gang bar structure 12, left and right brush assemblies 14 and 16, a left flexible member assembly 18, and a right flexible member assembly 20.

Gang bar structure 12 includes a gang bar 22, a hinge tube 24 fixedly secured at each end of the gang bar and extending generally perpendicular to the lengthwise axis of the gang bar, a pair of angularly spaced stop members **24*a* and 24*b* secured to and projecting downwardly from each hinge tube, and a hinge pin 26** positioned in each hinge tube.

Each broom assembly 14, 16 includes a rigid broom bar 28, a bristle assembly 30 carried by and extending downwardly from the broom bar, and a pair of hinge knuckles 32 secured as by fasteners 34 to the opposite ends of the broom bar and journalled on respective ends of the respective hinge pin 26. The described arrangement pivotally mounts each brush assembly on a respective hinge pin 26 with the extent of rearward pivotal movement determined and delimited by a respective stop **24*a* and the extent of forward pivotal movement determined and delimited by a respective forward stop 24*b***.

Left flexible member assembly 18 includes a main body portion **18*a* and a yoke portion 18b suitably secured to laterally spaced locations on the hinge tube 24 of the left brush assembly, and right flexible member assembly 20 includes a main body portion 20*a* and a yoke portion 20*b* suitably secured to laterally spaced locations on the hinge tube 24 of the right brush assembly. Flexible members 18 and 20** may, for example, comprise ropes.

Figure 2:
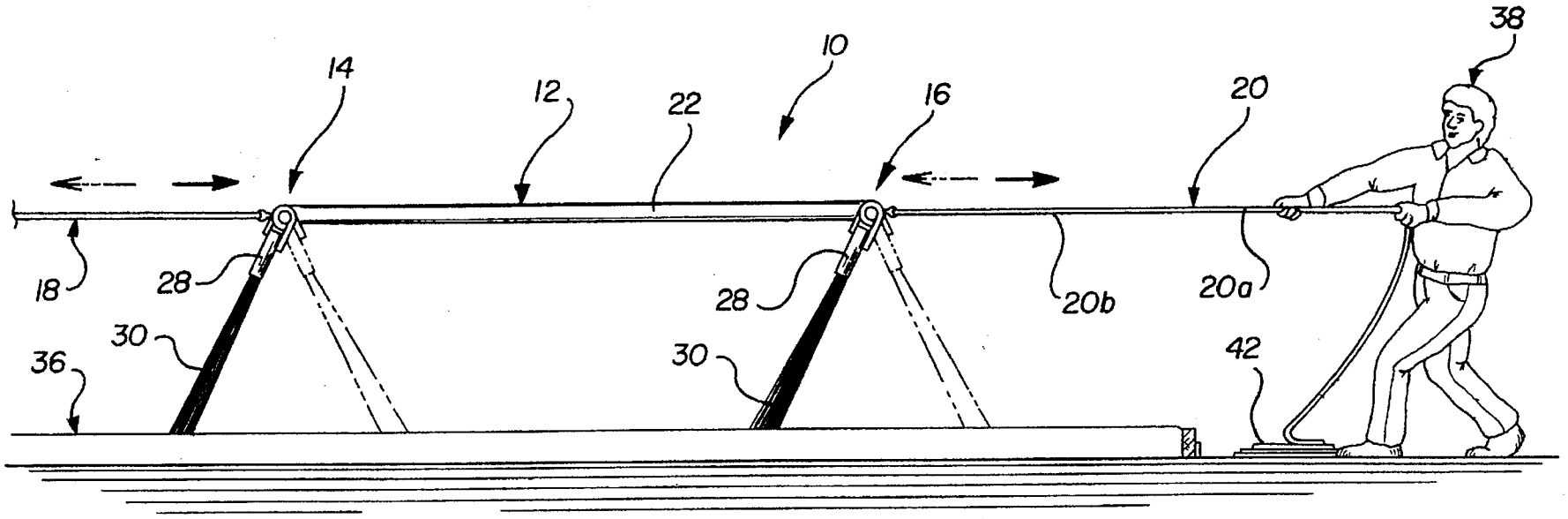
FIG. 2 is a schematic side elevational view of the invention smoothing apparatus.

To smooth a freshly laid concrete pad 36 utilizing the invention apparatus and methodology, smoothing apparatus 10 is positioned in one corner of pad 36 in overlying relation to a section **36*a* of the pad and the smoothing apparatus is moved along section 36*a*, across the entire width of the pad, by a first worker 38 positioned on one side of the pad and pulling on rope 20 and a second worker 40 positioned on an opposite side of the pad and playing out rope 18. As the smoothing apparatus is pulled across the pad, the broom assemblies pivot to their rearwardly angled positions as determined by stops 24*a* and as seen in solid lines in FIG. 2, whereby to perform a smooth sweeping and levelling action on the surface of the pad. As the smoothing apparatus is moved across the pad, the rope 20 is reeled in by the worker 38 and arranged in a rope coil 42 while the rope 18 is played out by the worker 40 to deplete a rope coil 44**.

After the smoothing apparatus has moved across the pad and reached the far side of the pad to complete the smoothing of section **36*a*, workers 38 and 40 work together to lift the smoothing apparatus to the next laterally adjacent section 36***b*. Thereafter, the procedure is reversed with worker 40 pulling on rope 18, worker 38 playing out rope 20, and the broom assemblies 14 and 16 angling forwardly (as seen in dash lines in FIG. 2) against the forward stops 24*b* to perform a smooth sweeping action as the smoothing apparatus once again moves across the pad, in an opposite direction, to smooth the section 36*b*. This procedure is repeated on successive pad sections 36*c*, etc., with the direction of movement of the smoothing apparatus across the pad being reversed for each successive pad section, until the entire pad has been smoothed.

The invention will be seen to provide an apparatus and methodology for quickly and effectively smoothing freshly laid concrete utilizing a simple and inexpensive apparatus and requiring relatively unskilled labor.

Whereas the invention has been illustrated and described in detail with respect to a preferred embodiment, it will be apparent that various changes may be made in the disclosed embodiment without departing from the scope or spirit of the invention.

I claim:

1. A method of manually smoothing a pad of fresh concrete comprising the steps of:

providing a broom assembly having a bristle structure;

providing a hinge structure mounting the broom assembly for pivotal movement and including stop means operative to limit the pivotal movement to movement between first and second angularly displaced positions;

providing a first flexible member arranged to pull the broom assembly in one direction;

providing a second flexible member arranged to pull the broom assembly in an opposite direction;

positioning a first worker at one side of the pad;

positioning a second worker at an opposite side of the pad;

positioning the broom assembly on a first section of the pad with the broom assembly in said first angularly displaced position;

moving the broom assembly in said one direction across the first section of the pad with the first worker pulling on the first flexible member and the second worker commensurately letting out the second flexible member whereby to move the broom assembly across the pad to smooth the first section of the pad, the hinge structure functioning in response to movement of the broom assembly in said one direction across the pad to move the broom assembly to said first angularly displaced position;

thereafter moving the broom assembly laterally on the pad to a second section of the pad laterally adjacent the first pad section and moving the broom assembly in said opposite direction across the second section of the pad, the second worker pulling on the second flexible member, and the first worker commensurately letting out the first flexible member, whereby to smooth the second section of the pad, the hinge structure functioning in response to movement of the broom assembly in said opposite direction across the pad to move the broom assembly to said second angularly displaced position; and repeating the procedure for successive pad sections, with the direction of movement of the broom assembly across the pad, and the angularly displaced position of the broom assembly, being reversed for each successive pad section, until the entire pad has been smoothed.

2. A smoothing apparatus for smoothing a fresh pad of concrete comprising:

a broom assembly having a bristle structure;

a hinge structure mounting the broom assembly for pivotal movement and including stop means operative to limit the pivotal movement to movement between first and second angularly displaced positions;

a first flexible member connected to the broom assembly and operative to move the broom assembly across the pad in one direction in response to pulling on the first flexible member; and a second flexible member connected to the broom assembly and operative to move the broom assembly across the pad in an opposite direction in response to pulling on the second flexible member;

the hinge structure functioning in response to movement of the broom assembly across the pad in said one direction to allow the broom assembly to assume its first angularly displaced position and functioning in response to movement of the broom assembly across the pad in said opposite direction to allow the broom assembly to assume its second angularly displaced position.

3. A smoothing apparatus according to claim 2 wherein:

the broom assembly comprises a first broom assembly; and the smoothing apparatus further includes a second broom assembly including a bristle structure, movable between first and second angularly displaced positions, and a gang bar structure joining the first and second broom assemblies so that the broom assemblies may be moved in unison across the pad;

the first and second flexible members being connected to opposite ends of the smoothing apparatus and being operative to move the smoothing apparatus in opposite directions across the pad.

4. A method of performing a finishing operation on a surface area comprising the steps of:

providing a finishing assembly including a transversely extending finishing tool including a rigid transversely extending bar structure and a hinge structure mounting the finishing tool for pivotal movement about a pivot axis between first and second angularly displaced positions;

providing a first flexible member arranged to pull the finishing assembly across the surface area in one direction;

providing a second flexible member arranged to pull the finishing assembly across the surface area in an opposite direction;

positioning a first worker at one side of the surface area;

positioning a second worker at an opposite side of the surface area;

positioning the finishing tool on a first section of the surface area;

moving the finishing assembly in said one direction across the first section of the surface area with the first worker pulling on the first flexible member and the second worker commensurately letting out the second flexible member whereby to move the finishing assembly across the surface area and perform a finishing operation on the first section of the surface area, the hinge structure functioning in response to movement of the finishing assembly across the pad in said one direction to move the finishing tool to said first angularly displaced position;

thereafter moving the finishing assembly laterally on the surface area to a second section of the surface area laterally adjacent the first section and moving the finishing assembly in said opposite direction across the second section of the surface area, the second worker pulling on the second flexible member and the first worker commensurately letting out the first flexible member, whereby to perform a finishing operation on the second section of the surface area, the hinge structure functioning in response to movement of the finishing assembly across the pad in said opposite direction to move the finishing tool to said second angularly displaced position; and repeating the procedure for successive surface area sections with the direction of movement of the tool across the surface area and the angular position of the finishing tool being reversed for each successive surface area section until the finishing operation has been performed on the entire surface area.

5. An apparatus for performing a finishing operation on a surface area comprising:

a rigid longitudinally extending frame structure defining longitudinally spaced forward and rearward locations;

a first transversely extending finishing device including a rigid transversely extending forward bar structure;

a forward hinge structure pivotally mounting the first transversely extending finishing device on the rigid longitudinally extending frame structure at the forward location for pivotal movement about a forward pivot axis with the forward bar structure extending transverse to the longitudinally extending frame structure and parallel to the forward pivot axis;

a second transversely extending finishing device including a rigid transversely extending rearward bar structure;

a rearward hinge structure pivotally mounting the second transversely extending finishing device on the rigid longitudinally extending frame structure at the rearward location for pivotal movement about a rearward pivot axis with the rearward bar structure extending transverse to the longitudinally extending frame structure and parallel to the rearward pivot axis; and a flexible line attached to the apparatus for pulling the apparatus in a longitudinal direction along the surface area.

6. An apparatus for performing a finishing operation on a surface area comprising: extending a finishing assembly including a transversely extending finishing tool including a rigid transversely extending bar structure and a hinge structure mounting the finishing tool for pivotal movement about a pivot axis between first and second angularly displaced positions with the transversely extending bar structure extending parallel to the pivot axis;

a first flexible member connected to the finishing assembly and operative to move the finishing assembly across the surface area in one longitudinal direction in response to pulling on the first flexible member; and a second flexible member connected to the finishing assembly and operative to move the finishing assembly across the surface area in an opposite longitudinal direction in response to pulling on the second flexible member;

the hinge structure functioning in response to movement of the finishing tool across the pad in said one direction to allow the finishing tool to assume its first angularly displaced position and functioning in response to movement of the finishing device across the pad in said opposite direction to allow the finishing device to assume its second angularly displaced position.

7. A finishing apparatus according to claim 6 wherein:

the finishing assembly comprises a first finishing assembly including a first finishing tool; and the finishing apparatus further includes a second finishing assembly including a second finishing tool, moveable between first and second angularly displaced positions, and a frame structure joining the first and second finishing assemblies so that the finishing assemblies may be moved in unison across the surface area;

the first and second flexible members being connected to opposite ends of the finishing apparatus and being operative to move the finishing apparatus in opposite directions across the surface area.

8. An apparatus for performing a finishing operation on a surface area comprising:

a rigid longitudinal extending frame structure defining longitudinally spaced forward and rearward locations;

a first elongated finishing device including a first elongated surface engaging edge;

a forward hinge structure at the forward location of the frame structure defining a forward pivot axis extending transversely to the longitudinal extent of the frame structure;

means mounting the first finishing device on the forward hinge structure with the device extending transversely to the longitudinal extent of the frame structure and mounted at a location on the first device remote from the first finishing edge for pivotal movement about the forward pivot axis;

a second elongated finishing device including a second elongated surface engaging edge;

a rearward hinge structure at the rearward location of the frame structure defining a rearward pivot axis extending transversely to the longitudinal extent of the frame structure;

means mounting the second finishing device on the rearward hinge structure with the device extending transversely to the longitudinal extent of the frame structure and mounted at a location on the second device remote from the second finishing edge for pivotal movement about the rearward pivot axis; and means for moving the apparatus in a longitudinal direction along the surface area with the finishing edges engaging the surface area so that the first finishing edge performs a first finishing operation on the surface area and the second finishing edge performs a second, subsequent finishing operation on the surface area.

9. A smoothing apparatus for smoothing a fresh pad of concrete comprising:

a broom assembly having a bristle structure pivotally movable between first and second angularly displaced positions;

a first flexible member connected to the broom assembly and operative to move the broom assembly across the pad in one direction in response to pulling on the first flexible member; and a second flexible member connected to the broom assembly and operative to move the broom assembly across the pad in an opposite direction in response to pulling on the second flexible member;

the broom assembly comprising a first broom assembly;

the smoothing apparatus further including a second broom assembly including a bristle structure, movable between first and second angularly displaced positions, and a gang bar structure joining the first and second broom assemblies so that the broom assemblies may be moved in unison across the pad;

the first and second flexible members being connected to opposite ends of the smoothing apparatus and being operative to move the smoothing apparatus in opposite directions across the pad;

the gang bar structure including a gang bar, a hinge structure at each end of the gang bar pivotally mounting a respective broom assembly, and stop means at each hinge structure operative to limit the pivotal movement of the respective broom assembly.

10. A finishing apparatus for performing a finishing operation on a surface area comprising:

a finishing first assembly including a finishing first tool pivotally moveable between first and second angularly displaced positions;

a first flexible member connected to the finishing first assembly and operative to move the finishing apparatus across the surface area in one direction in response to pulling on the first flexible member; and a second flexible member connected to the finishing apparatus and operative to move the finishing apparatus across the surface area in an opposite direction in response to pulling on the second flexible member;

a second finishing assembly including a second finishing tool, moveable between first and second angularly displaced positions, and a frame structure joining the first and second finishing assemblies so that the finishing assemblies may be moved in unison across the surface area;

the first and second flexible members being connected to opposite ends of the finishing apparatus and being operative to move the finishing apparatus in opposite directions across the surface area;

the frame structure including a bar, a hinge structure at each end of the bar pivotally mounting a respective finishing assembly, and means operative to limit the pivotal movement of the respective finishing assembly.

11. A method of manually smoothing a pad of fresh concrete comprising the steps of:

providing a broom assembly having a bristle structure pivotally movable between first and second angularly displaced positions;

providing a first flexible member arranged to pull the broom assembly in one direction;

providing a second flexible member arranged to pull the broom assembly in an opposite direction;

positioning a first worker at one side of the pad;

positioning a second worker at an opposite side of the pad;

positioning the broom assembly on a first section of the pad with the bristle structure in said first angular position;

moving the broom assembly in said one direction across the first section of the pad with the first worker pulling on the first flexible member and the second worker commensurately letting out the second flexible member whereby to move the broom assembly across the pad to smooth the first section of the pad;

thereafter moving the broom assembly laterally on the pad to a second section of the pad laterally adjacent the first pad section and moving the broom assembly in said opposite direction across the second section of the pad with the bristle structure in said second angular position, the second worker pulling on the second flexible member, and the first worker commensurately letting out the first flexible member, whereby to smooth the second section of the pad; and repeating the procedure for successive pad sections, with the direction of movement of the broom assembly across the pad being reversed for each successive pad section, until the entire pad has been smoothed;

the broom assembly comprising a first broom assembly and forming a part of a smoothing apparatus;

the smoothing apparatus further including a second broom assembly including a bristle structure, pivotally moveable between first and second angularly displaced positions, and a gang bar joining the first and second broom assemblies; and the first and second flexible members being connected to opposite ends of the smoothing apparatus and being operative to move the smoothing apparatus in opposite directions across the pad.

12. A method of performing a finishing operation on a surface area comprising the steps of:

providing a finishing assembly including a finishing tool pivotally moveable between first and second angularly displaced positions;

providing a first flexible member arranged to pull the finishing assembly across the surface area in one direction;

providing a second flexible member arranged to pull the finishing assembly across the surface area in an opposite direction;

positioning a first worker at one side of the surface area;

positioning a second worker at an opposite side of the surface area;

positioning the finishing tool on a first section of the surface area with the tool in said first angularly displaced position;

moving the finishing assembly in said one direction across the first section of the surface area with the first worker pulling on the first flexible member and the second worker commensurately letting out the second flexible member whereby to move the finishing assembly across the surface area and perform a finishing operation on the first section of the surface area;

thereafter moving the finishing assembly laterally on the surface area to a second section of the surface area laterally adjacent the first section and moving the finishing assembly in said opposite direction across the second section of the surface area with the tool in said second angularly displaced position, the second worker pulling on the second flexible member and the first worker commensurately letting out the first flexible member, whereby to perform a finishing operation on the second section of the surface area; and repeating the procedure for successive surface area sections with the direction of movement of the tool across the surface area and the angular position of the finishing tool being reversed for each successive surface area section until the finishing operation has been performed on the entire surface area;

the finishing assembly comprising a first finishing assembly including a first finishing tool and forming a part of a finishing apparatus;

the finishing apparatus further including a second finishing assembly including a second finishing tool, pivotally moveable between first and second angularly displaced positions, and a frame structure joining the first and second finishing assemblies; and the first and second flexible members being connected to opposite ends of the finishing apparatus and being operative to move the finishing apparatus in opposite directions across the surface area.

* * * * *

UNITED STATES PATENT AND TRADEMARK OFFICE

CERTIFICATE OF CORRECTION

PATENT NO. : 5,660,019

DATED : August 26, 1997

INVENTOR(S) : Cliffton L. Roe

It is certified that error appears in the above-indentified patent and that said Letters Patent is hereby corrected as shown below:

Column 5, Line 45, delete "extending".

Column 5, Line 45, begin new paragraph before "a finishing".

Column 7, Line 12, delete "finishing first" and insert --first finishing-- (first occurrence).

Column 7, Line 12, delete "finishing first" and insert --first finishing-- (second occurrence).

Column 7, Line 15, delete "finishing first" and insert --first finishing--.

Column 7, Line 18, delete "and".

Column 7, Line 25, begin new paragraph before "a frame".

Column 7, Line 25, change "positions, and" to --positions; and--.

Signed and Sealed this

Thirteenth Day of January, 1998

Bruce Lehman

*Attest:*

BRUCE LEHMAN

*Attesting Officer*

*Commissioner of Patents and Trademarks*